US010358795B2

(12) United States Patent
Hoshaku et al.

(10) Patent No.: US 10,358,795 B2
(45) Date of Patent: Jul. 23, 2019

(54) WORKING MACHINE

(71) Applicant: Caterpillar SARL, Geneva (CH)

(72) Inventors: Shota Hoshaku, Hyogo (JP); Koichi Murata, Hyogo (JP); Masashi Shibata, Hyogo (JP)

(73) Assignee: Caterpillar SARL, Geneva (CH)

( * ) Notice: Subject to any disclaimer, the term of this patent is extended or adjusted under 35 U.S.C. 154(b) by 0 days.

(21) Appl. No.: 15/752,690

(22) PCT Filed: Aug. 25, 2016

(86) PCT No.: PCT/EP2016/070129

§ 371 (c)(1),
(2) Date: Feb. 14, 2018

(87) PCT Pub. No.: WO2017/036932

PCT Pub. Date: Mar. 9, 2017

(65) Prior Publication Data

US 2018/0251956 A1 Sep. 6, 2018

(30) Foreign Application Priority Data

Aug. 28, 2015 (JP) ..... 2015-169136

(51) Int. Cl.
*E02F 9/20* (2006.01)
*E02F 3/43* (2006.01)
(Continued)

(52) U.S. Cl.
CPC ..... *E02F 9/2033* (2013.01); *E02F 3/437* (2013.01); *E02F 3/438* (2013.01); *E02F 9/123* (2013.01); *E02F 9/262* (2013.01); *E02F 9/265* (2013.01)

(58) Field of Classification Search
CPC ..... E02F 9/2033; E02F 3/437; E02F 3/438; E02F 9/123; E02F 9/262; E02F 9/265
(Continued)

(56) References Cited

U.S. PATENT DOCUMENTS

2013/0092858 A1* 4/2013 Sakatani ..... E02F 9/2004 251/231
2014/0245729 A1* 9/2014 Nanjo ..... E02F 9/226 60/414

FOREIGN PATENT DOCUMENTS

EP 2586918 A2 5/2013
JP S60-023532 A 2/1985
(Continued)

OTHER PUBLICATIONS

International Search Report for corresponding PCT Application No. PCT/EP2016/070129; dated Oct. 31, 2016.

*Primary Examiner* — Gertrude Arthur Jeanglaude

(57) ABSTRACT

Provided is a work machine which is capable of accurately preventing a work device from interfering with a load receiving member without separately using a dedicated device. A work machine includes a controller which at least controls rotating of an upper rotating body and vertical movement of a boom in accordance with operation by an operator. The controller controls either a boom-up operation and a rotating operation of the upper rotating body such that a work device is prevented from interfering with a load receiving member in operation of an operator at subsequent lifting and rotating, operation based on part of a locus at a distal end side of the work device at least for one lifting and rotating operation.

4 Claims, 4 Drawing Sheets

(51) Int. Cl.
*E02F 9/12* (2006.01)
*E02F 9/26* (2006.01)

(58) Field of Classification Search
USPC ..... 701/36, 50; 172/4.5, 9
See application file for complete search history.

(56) References Cited

FOREIGN PATENT DOCUMENTS

| | | | | |
|---|---|---|---|---|
| JP | H05-321290 | A | 12/1993 | |
| JP | 3-145027 | B2 | 3/2001 | |
| JP | 3145027 | B2 * | 3/2001 | ..... E02F 3/43 |
| JP | 2010/053588 | A | 3/2010 | |

* cited by examiner

WORKING MACHINE

CROSS-REFERENCE TO RELATED APPLICATION

This Application is a 35 USC § 371 US National Stage filing of International Application No. PCT/EP2016/070129 filed on Aug. 25, 2016 which claims priority under the Paris Convention to Japanese Serial No. 2015-169136 filed Aug. 28, 2015.

TECHNICAL FIELD

The present invention relates to a working machine including a working device with a working member receiving a load.

BACKGROUND ART

Among working machines such as an excavator having a working device with, for example, a boom, a stick, and an arm, and provided at an upper turning body axially supported to be rotatable on a lower traveling body, some working machines have a function of preventing the working device from interfering with (contacting) certain portions when the upper turning body is turned or components of the working device are operated in accordance with an operation of an operator.

For example, there is known a configuration in which a height of a working device is detected and an operation of turning an upper turning body is stopped when the height of the working device becomes a predetermined value or less during the turning operation (for example, see Patent Literature 1).

Further, as a technology of preventing interference when a load is loaded onto a load receiving member such as a truck, there is known a configuration in which an upper turning body is provided with a distance measurement instrument and an operation of turning the upper turning body is stopped when the upper turning body is too close to the load receiving member based on a distance measured by the distance measurement instrument during the turning operation (for example, see Patent Literature 2).

Furthermore, there is known a configuration in which a danger region is set in upper, lower, and front areas of a working machine in order to prevent a working device from contacting a barrier, and the working device is stopped while decelerating before the working device contacts the barrier (for example, see Patent Literature 3).

CITATION LIST

Patent Literature

[Patent Literature 1] Japanese Unexamined Patent Application, Second Publication No. 3-24535

[Patent Literature 2] Japanese Unexamined Patent Application, First Publication No. 2010-53588

[Patent Literature 3] Japanese Unexamined Patent Application, First Publication No. 5-321290

SUMMARY OF INVENTION

Technical Problem

However, in the above-described working machines, since interference is prevented based on the detection of exclusive sensors such as a distance measurement instrument, these sensors need to be separately installed and there is a concern that interference preventing precision may be deteriorated due to contamination of the sensors.

This invention is contrived in view of such circumstances and an object of the invention is to provide a working machine capable of very accurately preventing a working device from interfering with a load receiving member without separately using an exclusive device.

Solution to Problem

The invention of claim 1 provides a working machine including: a machine body which includes a lower traveling body and an upper turning body provided to be turnable on the lower traveling body; a working device which includes a boom axially connected to the upper turning body to be movable up and down and a working member provided to be operable at a front end of the working device to receive a load into the working member; and a controller which controls at least a turning movement of the upper turning body and an up and down movement of the boom in response to an operation of an operator, wherein the controller controls at least any one of a boom raising operation and an upper turning body turning operation so that the working device does not interfere with a load receiving member in a subsequent lifting and turning operation of the operator based on a track of a part of a front end of the working device during at least one lifting and turning operation of transporting the load received in the working member by raising the boom and turning the upper turning body so that the load is input into the load receiving member.

The invention of claim 2 provides the working machine according to claim 1, wherein the controller creates an estimation map which estimates a load receiving member existence range based on the track of the part of the front end of the working device during at least one lifting and turning operation and controls at least any one of the boom raising operation and the upper turning body turning operation so that the working device does not move within the load receiving member existence range estimated in the estimation map by an operation of the operator in the subsequent lifting and turning operation.

The invention of claim 3 provides the working machine according to claim 2, wherein the controller updates the estimation map so that the load receiving member existence range in the estimation map is reduced when the track of the part of the front end of the working device during an operation of moving the working member from a load input position by lowering the boom and turning the upper turning body is closer to the load receiving member than the track of the part of the front end of the working device during the lifting and turning operation.

The invention of claim 4 provides the working machine according to any one of claims 1 to 3, wherein the working member is an excavation bucket in which a load receiving position is an excavation position.

Advantageous Effects of Invention

According to the invention of claim 1, since it is possible to control at least any one of the boom raising operation and the upper turning body turning operation based on a track in which the working device does not interfere with the load receiving member during at least one lifting and turning operation without separately using a device such as an exclusive sensor, it is possible to very accurately prevent interference between the working device and the load receiving member.

According to the invention of claim 2, it is possible to set a reference for controlling at least any one of the boom raising operation and the upper turning body turning operation without using a complicated calculation more than is necessary.

According to the invention of claim 3, since it is possible to further very accurately set the load receiving member existence range by using an operation of moving the working member from the load input position by lowering the boom and turning the upper turning body, it is possible to further effectively prevent interference between the working device and the load receiving member.

According to the invention of claim 4, it is possible to effectively input a load such as soil excavated by the bucket into the load receiving member without any contact between the working device and the load receiving member.

DESCRIPTION OF EMBODIMENTS

Hereinafter, the invention will be described in detail based on an embodiment shown in FIGS. 1 to 4.

Figure 1:
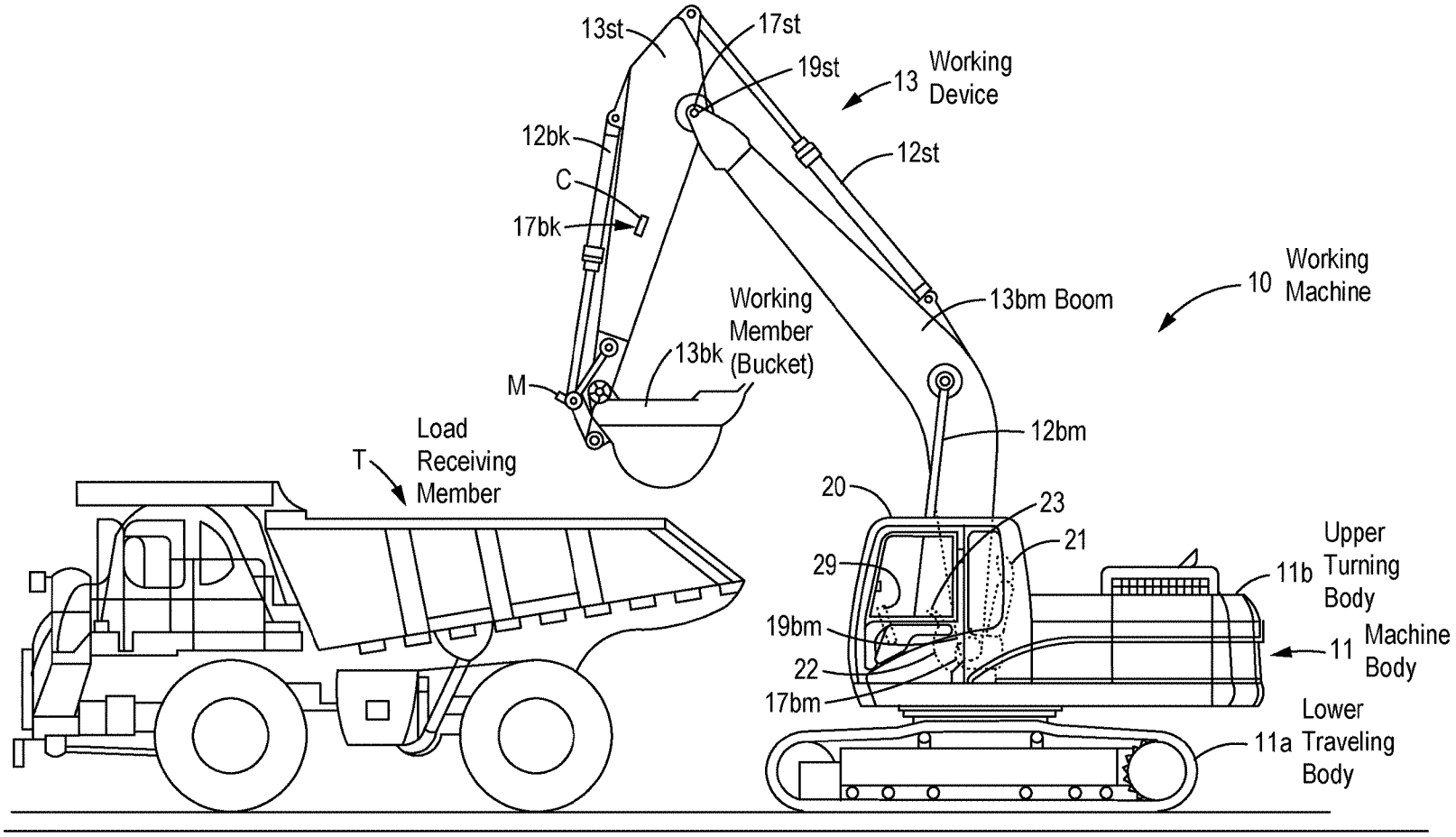
FIG. 1 is a side view of a working machine and a load receiving member in an embodiment of a working machine of the invention.

FIG. 1 shows an excavator-type working machine 10 and a working device 13 which is moved up and down by a boom cylinder 12*bm* which is a fluid pressure cylinder (a hydraulic cylinder) mounted on a machine body 11 having an upper turning body 11*b* provided to be turnable in a lower traveling body 11*a*. Then, the working machine 10 is used to transport a load (soil) to a load receiving member T such as a truck and to input the load thereinto (so that the soil is removed therefrom).

Figure 3:
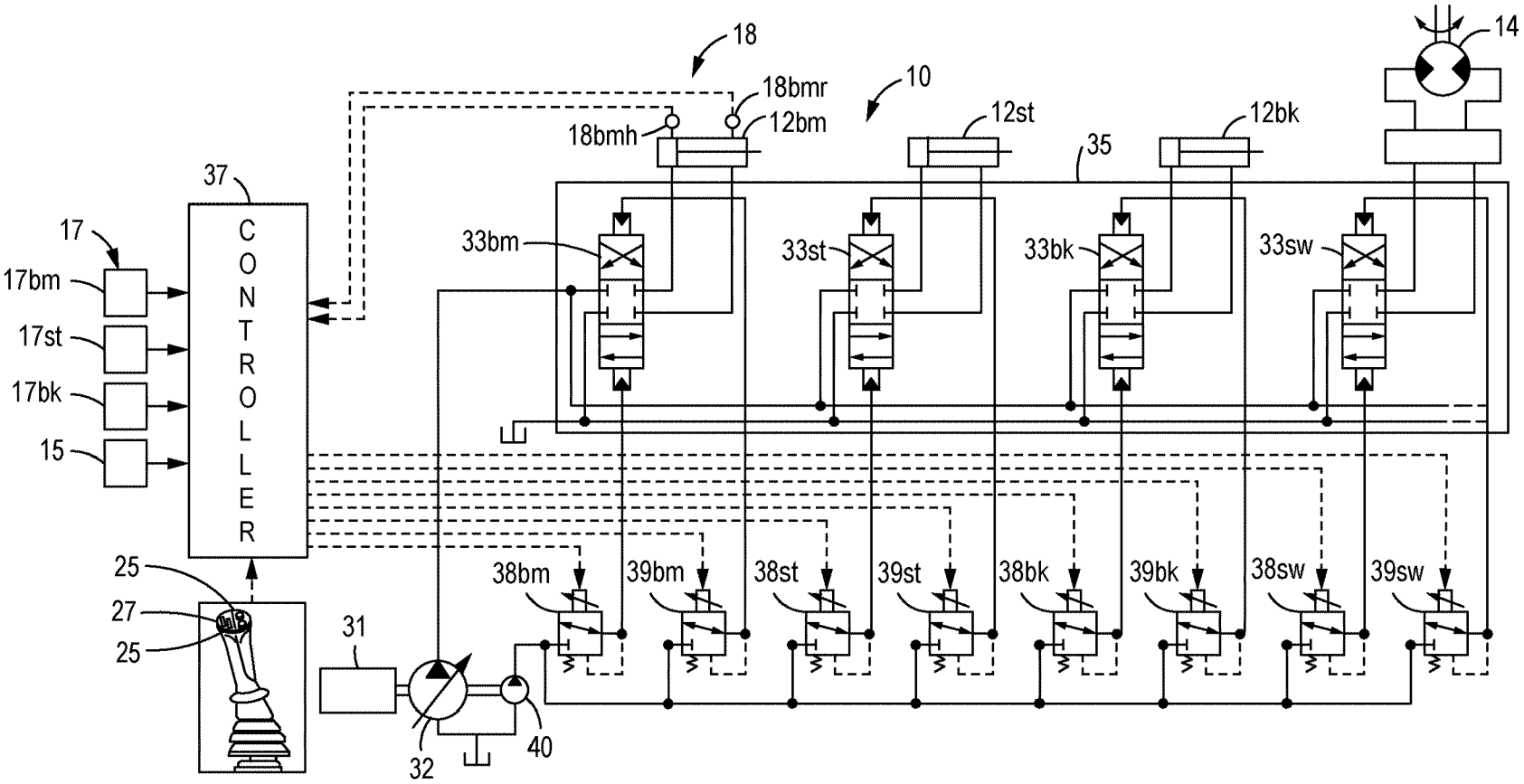
FIG. 3 is an outline diagram of the working machine.

In the machine body 11, the upper turning body 11*b* is turned by a turning motor 14 (FIG. 3) which is a fluid pressure motor (a hydraulic motor) with respect to the lower traveling body 11*a*. Further, the machine body 11 is provided with a turning sensor 15 (FIG. 3) which detects a turning position (a turning angle) of the upper turning body 11*b* with respect to the lower traveling body 11*a*. In the embodiment, for example, an angle sensor is used as the turning sensor 15 (FIG. 3). Further, the machine body 11 may be provided with, for example, a machine body orientation sensor (an inclination sensor) which detects an orientation such as an inclination of the machine body 11.

In the working device 13, a base end of a boom 13*bm* is axially supported to be rotatable in a vertical direction by the upper turning body 11*b*, a stick 13*st* is axially supported to be rotatable by a front end of the boom 13*bm*, a bucket 13*bk* which is an excavation working member is axially supported to be rotatable by a front end of the stick 13*st*, the boom 13*bm* is rotated by a boom cylinder 12*bm*, the stick 13*st* is rotated by a stick cylinder 12*st* which is a fluid pressure cylinder (a hydraulic cylinder), and the bucket 13*bk* is rotated by a bucket cylinder 12*bk* which is a fluid pressure cylinder (a hydraulic cylinder).

Further, the working device 13 is provided with sensors 17*bm*, 17*st*, and 17*bk* which is a boom orientation detection unit, a stick orientation detection unit, and a bucket orientation detection unit respectively detecting orientations of the boom 13*bm*, the stick 13*st*, and the bucket 13*bk* and a weight sensor 18 which detects a weight (a payload) of a load received by the bucket 13*bk*. Then, these sensors 17*bm*, 17*st*, and 17*bk* constitute an orientation sensor 17 which detects an orientation of the working device 13. That is, the orientation sensor 17 detects angles (positions) of the boom 13*bm*, the stick 13*st*, and the bucket 13*bk* constituting the working device 13.

As the sensors 17*bm*, 17*st*, and 17*bk*, for example, an angle sensor such as a potentiometer or a position sensor detecting a position is arbitrarily used. However, in the embodiment, for example, angle sensors are used as the sensors 17*bm* and 17*st* and a position sensor is used as the sensor 17*bk*.

The sensor 17*bm* is attached to, for example, a boom foot pin 19*bm* which axially supports the boom 13*bm* by the machine body 11 (the upper turning body 11*b*).

The sensor 17*st* is attached to, for example, a pivot pin 19*st* (at a stick base end side) which axially supports a base end of the stick 13*st* by the front end of the boom 13*bm*.

The sensor 17*bk* detects, for example, a position of a marker M attached to a rod of the bucket cylinder 12*bk* by a detector (a laser catcher) C attached to a side portion of the stick 13*st*. When a telescopic movement of the bucket cylinder 12*bk* is detected, a position (a rotation angle) of the bucket 13*bk* with respect to the stick 13*st* is detected.

Further, rotation angles detected by the sensors 17*bm*, 17*st*, and 17*bk* can be detected as an absolute angle by, for example, a body tilting angle in the embodiment. However, for example, relative angles of the boom 13*bm*, the stick 13*st*, and the bucket 13*bk* with respect to the machine body 11, the boom 13*bm*, and the stick 13*st* may be respectively detected.

The weight sensor 18 may have an arbitrary configuration, but the weight of the load inside the bucket 13*bk* is obtained by a calculation of a balance in moment based on, for example, the orientations of the boom 13*bm* and the stick 13*st* detected by the sensors 17*bm* and 17*st* and a head side pressure and a rod side pressure of the boom cylinder 12*bm* detected by a pressure sensor 18*bmh* and a pressure sensor 18*bmr*.

Further, a cab 20 for protecting a working space of an operator is mounted onto one side of the upper turning body 11*b*. Inside the cab 20, an operation lever 23 serving as an operation unit is provided at an upper portion of a console 22 provided at each of left and right portions of a driver seat 21. Further, a monitor 29 serving as an input unit and a display unit is provided inside the cab 20.

As shown in FIG. 3, an upper front surface portion of each operation lever 23 is provided with a push button type switch 25 and a thumb wheel type switch 27. These switches 25 and 27 or the monitor 29 shown in FIG. 1 can be used as an interference preventing function switching switch which automatically prevents the working device 13 from interfering with the load receiving member T during a lifting and turning operation of turning the upper turning body 11*b* with respect to the lower traveling body 11*a* while lifting the bucket 13*bk* having a load received therein by raising the boom. An operation and a control when the interference preventing function is enabled will be described below.

Then, FIG. 3 shows an outline of a control circuit which controls the working device 13 and spools 33*bm*, 33*st*, 33*bk*, and 33*sw*, which correspond to control valves controlling working oil which is a working fluid supplied to the cylinders 12*bm*, 12*st*, and 12*bk* and the turning motor 14 from a main pump 32 driven by an in-vehicle engine 31, are movably provided inside a block 35. Further, a traveling motor control spool is also movably provided inside the block 35, but is not shown in the drawings in order to clarify the description.

The boom cylinder 12*bm* is a single rod type hydraulic cylinder which operates the working device 13 (FIG. 1) in the vertical direction. When the boom cylinder is operated in a lengthening direction by the operation lever 23, the working device 13 (the boom 13*bm*) shown in FIG. 1 is operated in a raising direction with respect to the machine body 11 (the upper turning body 11*b*) (a boom raising operation). Meanwhile, when the boom cylinder is operated in a shortening direction, the working device 13 (the boom 13*bm*) is operated in a lowering direction with respect to the machine body 11 (the upper turning body 11*b*) (a boom lowering operation).

The stick cylinder 12*st* is a single rod type hydraulic cylinder which operates the stick 13*st* in an anteroposterior direction with respect to the boom 13*bm*. When the stick cylinder is operated in a lengthening direction by the operation lever 23 (FIG. 3), the stick 13*st* is moved in a front direction with respect to the boom 13*bm*, that is, a direction moving away from the operator (a stick-out operation). Meanwhile, when the stick cylinder is operated in a shortening direction, the stick 13*st* is moved in a rear direction with respect to the boom 13*bm*, that is, a direction moving close to the operator (a stick-in operation).

The bucket cylinder 12*bk* is a single rod type hydraulic cylinder which operates the bucket 13*bk* in an anteroposterior direction with respect to the stick 13*st*. When the bucket cylinder is operated in a lengthening direction by the operation lever 23 (FIG. 3), the bucket 13*bk* is moved in a front direction with respect to the stick 13*st* (a bucket-out operation). Meanwhile, when the bucket cylinder is operated in a shortening direction, the bucket 13*bk* is moved in a rear direction with respect to the stick 13*st* (a bucket-in operation).

Returning to FIG. 3, electromagnetic proportional valves 38*bm*, 39*bm*, 38*st*, 39*st*, 38*bk*, 39*bk*, 38*sw*, and 39*sw* are pressure reducing valves which convert a first pilot pressure supplied from a pilot pump 40 into a second pilot pressure in response to a control signal from a controller 37 and applies the pressure to pilot pressure action portions of the spools 33*bm*, 33*st*, 33*bk*, and 33*sw*.

The controller 37 outputs an electric signal for operating the cylinders 12*bm*, 12*st*, and 12*bk* and the turning motor 14 while an input unit is electrically connected to the turning sensor 15, the orientation sensor 17 (the sensors 17*bk*, 17*bm*, and 17*st*), the weight sensor 18, and the operation levers 23 and an output unit is electrically connected to solenoids of the electromagnetic proportional valves 38*bm*, 39*bm*, 38*st*, 39*st*, 38*bk*, 39*bk*, 38*sw*, and 39*sw*. Further, the controller 37 may electrically detect the second pilot pressure converted by the electromagnetic proportional valves 38*bm*, 39*bm*, 38*st*, 39*st*, 38*bk*, 39*bk*, 38*sw*, and 39*sw*.

Next, an operation of the embodiment shown in the drawings will be described.

The working machine 10 receives a load (soil) into the bucket 13*bk* by an excavating operation and inputs the load into the load receiving member T such as a truck (so that the soil is removed therefrom) by performing a lifting and turning operation of lifting the bucket 13*bk* having the load received therein by raising the boom while turning the upper turning body 11*b* with respect to the lower traveling body 11*a*. When a series of tasks are repeated, a predetermined amount of the load is transported to the load receiving member T. For example, as shown in FIG. 1, when a rear portion of the load receiving member T is located at a front side of the working machine 10, the working machine 10 performs an excavating operation by the bucket 13*bk* and turns the upper turning body 11*b* by about 90° in a bucket-in state. In the series of tasks, the operator can manually set whether to enable the interference preventing function by, for example, switching the switches 25 and 27 (FIG. 3) or inputting an instruction to the monitor 29.

Figure 2:
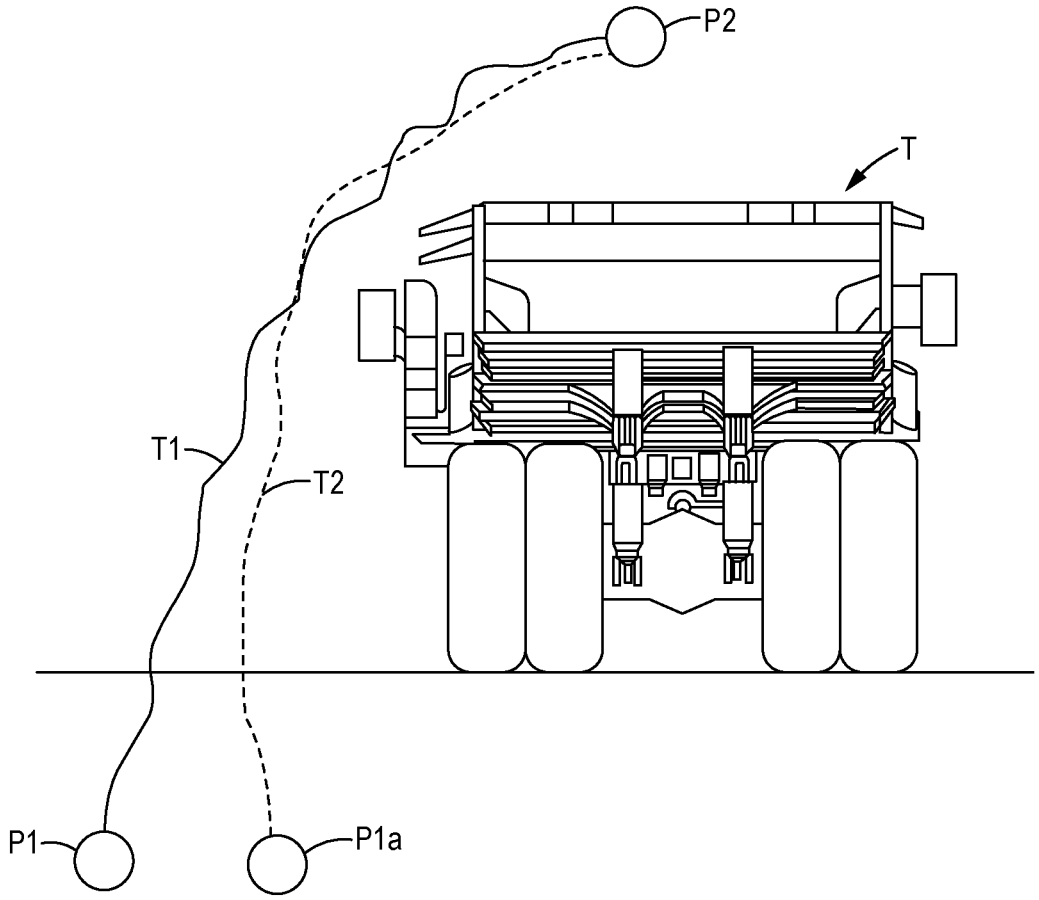
FIG. 2 is an explanatory diagram schematically showing a front end side track of a working device of the working machine with respect to the load receiving member during a lifting and turning operation.

When the interference preventing function is enabled, the controller 37 records a front end side track T1 (FIG. 2) of the working device 13 by sequentially recording a minimal height of the front end of the working device 13 from a first load receiving position, that is, an excavation position (an excavation point) P1 (FIG. 2), to a load input position, that is, a soil discharging position (a soil removing point) P2 (FIG. 2), for example, a position of the lowest portion of the bucket 13*bk* or the stick 13*st*, and controls the boom raising operation and the operation of turning the upper turning body 11*b* so that the working device 13 does not interfere with the load receiving member T by an operation of the operator in subsequent (second or following) lifting and turning operation based on the track T1 (FIG. 2).

That is, when the operator carefully operates the working device 13 so that the working device does not interfere with the load receiving member T during the lifting and turning operation of a first task, the working device 13 does not interfere with the load receiving member T as long as the working device moves along a track including the front end side track of the working device 13 at this time, that is, a position separated from the load receiving member T. For that reason, when the boom raising operation and the operation of turning the upper turning body 11*b* are controlled so that the working device 13 does not enter into the first track, that is, toward the load receiving member T from the second lifting and turning operation, interference of the working device 13 with respect to the load receiving member T can be prevented.

Specifically, when the controller 37 first detects a first load receiving operation, that is, a lifting and turning operation after the excavating operation using the bucket 13*bk*, the controller records the position of the lowest portion of the bucket 13*bk* detected by the sensor 17*bk* of the orientation sensor 17 or the position of the lowest portion of the stick 13*st* detected by the sensor 17*st*, that is, a front end side position of the working device 13, until the load is input to the load receiving member T, that is, a soil removing operation is detected. Further, in order to detect the excavating operation, the lifting and turning operation, and the soil removing operation, an arbitrary existing method is used based on at least any one of, for example, an operational input of the operation lever 23, a weight (a head pressure and a rod pressure of the boom cylinder 12*bm*) of the load detected by the weight sensor 18 (the sensors 18*bmh* and 18*bmr*), a changed speed thereof, a turning angle of the upper turning body 11*b* detected by the turning sensor 15, a changed speed and a changed direction thereof, positions of the bucket 13*bk*, the boom 13*bm*, and the stick 13*st* detected by the orientation sensor 17 (the sensors 17*bk*, 17*bm*, and 17*st*), and a changed speed and a changed direction thereof. Then, the controller 37 creates an estimation map which estimates a range (a position) in which the load receiving member T exists based on the track T1 of the front end (the lowest portion of the bucket 13*bk* or the lowest portion of the stick 13*st*) of the working device 13 calculated by continuously plotting the above-described recorded position. Then, in a series of tasks from a second load receiving operation (the excavating operation) to the load inputting operation (the soil removing operation), the controller monitors the position of the lowest portion of the bucket 13*bk* or the position of the lowest portion of the stick 13*st* in the lifting and turning operation, that is, the position, the speed, and the direction of the front end of the working device 13, and controls an opening degree of the spool 33*bm* and/or the spool 33*sw* so that the front end side position of the working device 13 does not enter a range in which the load receiving member T exists in the estimation map by ignoring the operation of the operator when such an entering is about to happen. In this way, the boom raising operation and the operation of turning the upper turning body 11*b* are controlled.

Additionally, when a first soil removing operation ends, the operator lowers the boom and turns the upper turning body 11*b* with respect to the lower traveling body 11*a* (in an opposite turning direction) to return the bucket 13*bk* to the excavation position and starts a second excavating operation. Here, when the interference preventing function is enabled, the controller 37 may record a front end side track T2 of the working device 13 by sequentially recording the position of the front end of the working device 13, for example, the position of the lowest portion of the bucket 13*bk* or the stick 13*st*, until the working device returns from the soil discharging position to the excavation position in an operation after the first soil removing operation, and may update the estimation map based on the track T2.

That is, the soil discharging position is basically the same position every time unless a relative position between the working machine 10 and the load receiving member T changes, but the excavation position returned to from the soil discharging position can be changed every time (for example, excavation positions P1 and P1*a* of FIG. 2). Further, an existence range of the load receiving member T is smaller than that of a current estimation if the working device 13 does not interfere with the load receiving member T although the track T2 of the front end (the lowest portion of the bucket 13*bk* or the lowest portion of the stick 13*st*) of the working device 13 enters into the track T1, that is, a position near the load receiving member T. For this reason, when the estimation map is updated to reduce the existence range of the load receiving member T to correspond to a position closer to the load receiving member T than the track T1 in the track T2, it is possible to expect improvement in accuracy of the interference preventing function in subsequent lifting and turning operation.

Specifically, when the controller 37 detects a soil removing operation, the controller records the position of the lowest portion of the bucket 13*bk* detected by the sensor 17*bk* of the orientation sensor 17 or the position of the lowest portion of the stick 13*st* detected by the sensor 17*st*, that is, the front end side position of the working device 13, until the load is received, that is, the excavating operation is detected. Then, when the track T2 of the front end (the lowest portion of the bucket 13*bk* or the lowest portion of the stick 13*st*) of the working device 13 calculated by continuously plotting the above-described recorded position includes a position near the load receiving member T which is inside the track T1, in other words, a portion entering the existence range of the load receiving member T, the controller 37 reduces the existence range of the load receiving member T at this portion.

Figure 4:
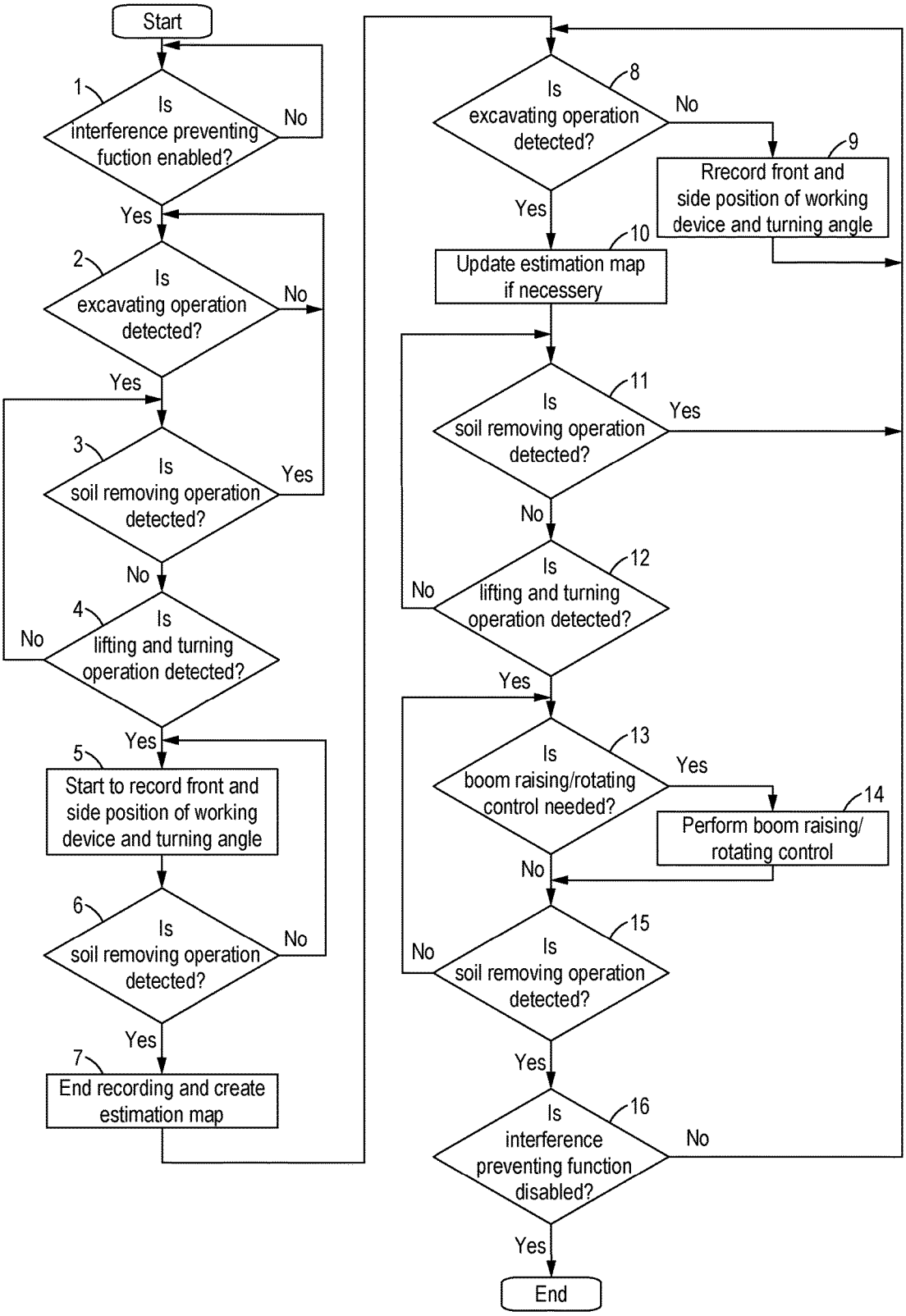
FIG. 4 is a flowchart showing a control of the working machine.

A control using the controller 37 will be described in detail with reference to a flowchart shown in FIG. 4. Further, circled numbers in the flowchart indicate step numbers.

(Step 1)

The controller 37 determines whether the interference preventing function is enabled. When the controller determines that the interference preventing function is not enabled (disabled) in step 1, step 1 is repeated. Meanwhile, when the controller determines that the interference preventing function is enabled, a routine proceeds to step 2.

(Step 2)

The controller 37 determines whether an excavating operation is detected. When the controller determines that the excavating operation is not detected in step 2, step 2 is repeated. Meanwhile, when the controller determines that the excavating operation is detected, the routine proceeds to step 3.

(Step 3)

The controller 37 determines whether a soil removing operation is detected. When the controller determines that the soil removing operation is detected in step 3, the routine returns to step 2. Meanwhile, when the controller determines that the soil removing operation is not detected, the routine proceeds to step 4.

(Step 4)

The controller 37 determines whether a lifting and turning operation is detected. When the controller determines that the lifting and turning operation is not detected in step 4, the routine returns to step 3. Meanwhile, when the controller determines that the lifting and turning operation is detected, the routine proceeds to step 5.

(Step 5)

The controller 37 starts to record a position of the front end (the lowest portion of the bucket 13*bk* or the lowest portion of the stick 13*st*) of the working device 13 and a turning angle of the upper turning body 11*b* and moves the routine to step 6.

(Step 6)

The controller 37 determines whether a soil removing operation is detected. When the controller determines that the soil removing operation is not detected in step 6, the routine returns to step 5. Meanwhile, when the controller determines that the soil removing operation is detected, the routine proceeds to step 7.

(Step 7)

The controller 37 ends the recording of the position of the front end (the lowest portion of the bucket 13*bk* or the lowest portion of the stick 13*st*) of the working device 13 and the turning angle of the upper turning body 11*b*, creates an estimation map based on the track T1 calculated from this record, and moves the routine to step 8. In this step, a series of tasks including a first excavating operation, the lifting and turning operation, and the soil removing operation end.

(Step 8)

The controller 37 determines whether an excavating operation is detected. When the controller determines that the excavating operation is not detected in step 8, the routine proceeds to step 9. Meanwhile, when the controller determines that the excavating operation is detected, the routine proceeds to step 10.

(Step 9)

The controller 37 records a position of the front end (the lowest portion of the bucket 13*bk* or the lowest portion of the stick 13*st*) of the working device 13 and a turning angle of the upper turning body 11*b* and returns the routine to step 8.

(Step 10)

The controller 37 updates the estimation map if necessary based on the track T2 calculated from the recorded position of the front end (the lowest portion of the bucket 13*bk* or the lowest portion of the stick 13*st*) of the working device 13 and the recorded turning angle of the upper turning body 11*b*, that is, the current position of the front end of the working device 13, and moves the routine to step 11. That is, when the track T2 is closer to an existence range of the load receiving member T than the track T1, the estimation map is updated. Otherwise, the estimation map is not updated.

(Step 11)

The controller 37 determines whether a soil removing operation is detected. When the controller determines that the soil removing operation is detected in step 11, the routine returns to step 8. Meanwhile, when the controller determines that the soil removing operation is not detected, the routine proceeds to step 12.

(Step 12)

The controller 37 determines whether a lifting and turning operation is detected. In step 12, when the controller determines that the lifting and turning operation is not detected, the routine returns to step 11. When the controller determines that the lifting and turning operation is detected, the routine proceeds to step 13.

(Step 13)

The controller 37 compares a position, a speed, and a direction of the front end (the lowest portion of the bucket 13*bk* or the lowest portion of the stick 13*st*) of the working device 13 at a current time with the estimation map and determines whether to control a boom raising operation and/or an operation of turning the upper turning body 11*b*. That is, when the position, the speed, and the direction of the front end of the working device 13 are considered such that the front end moves into the existence range of the load receiving member T in the estimation map, the controller 37 determines that the boom raising operation and/or the operation of turning the upper turning body 11*b* is needed so that the front end avoids the existence range of the load receiving member T by ignoring an operation of an operator. When the controller determines that the control is needed in step 13, the routine proceeds to step 14. Meanwhile, when the controller determines that the control is not needed, the routine proceeds to step 15.

(Step 14)

The controller 37 controls the boom raising operation and/or the operation of turning the upper turning body 11*b* by controlling a flow amount and a direction of a working oil supplied to a head or a rod of the boom cylinder 12*bm* through the spool 33*bm* and/or a flow amount and a direction of a working oil supplied to the turning motor 14 through the spool 33*sw*, and moves the routine to step 15.

(Step 15)

The controller 37 determines whether a soil removing operation is detected. When the controller determines that the soil removing operation is not detected in step 15, the routine returns to step 13. Meanwhile, when the controller determines that the soil removing operation is detected, the routine proceeds to step 16.

(Step 16)

The controller 37 determines whether the interference preventing function is disabled. When the controller determines that the interference preventing function is not disabled (enabled) in step 16, the routine returns to step 8. Meanwhile, when the controller determines that the interference preventing function is disabled, the control ends.

As described above, according to the above-described embodiment, since at least one of the boom raising operation and the operation of turning the upper turning body 11*b* is controlled so that the working device 13 does not interfere with the load receiving member T in a subsequent lifting and turning operation of the operator based on the track T1 of a part of the front end of the working device 13 during at least one lifting and turning operation in which a load received by the bucket 13*bk* is transported by the boom raising operation and the operation of turning the upper turning body 11*b* and is input into the load receiving member T, it is possible to control at least one of the boom raising operation and the operation of turning the upper turning body 11*b* based on the track T1 in which the working device 13 does not interfere with the load receiving member T during at least one lifting and turning operation without separately using a device such as an exclusive sensor, and to very accurately prevent interference between the working device 13 and the load receiving member T.

In general, since the working machine 10 includes the turning sensor 15, the orientation sensor 17, and the weight sensor 18 in order to monitor the orientation or the operation of the working machine and the weight of the load, it is possible to perform the above-described control by using these sensors 15, 17, and 18 without requiring an additional sensor. Thus, it is possible to prevent problems in which soil adheres to a distance measurement sensor during the excavating operation and deterioration in accuracy is caused by contamination of the sensor, for example, in the case where the distance measurement sensor for measuring a distance between a front object and the front end of the bucket 13*bk* or the stick 13*st* is attached to the front end thereof.

Specifically, since the estimation map which estimates the existence range of the load receiving member T based on the track T1 of a part of the front end of the working device 13 during at least one lifting and turning operation is created, it is possible to set a reference for controlling at least any one of the boom raising operation and the operation of turning the upper turning body 11*b* so that the working device 13 does not move into the existence range of the load receiving member T estimated in the estimation map in a subsequent lifting and turning operation of the operator without using a complicated calculation more than is necessary.

Further, since the boom raising operation and the operation of turning the upper turning body 11*b* are not controlled in an operation other than the lifting and turning operation, it is possible to ensure a degree of freedom in a movement range of the working device 13 even when the interference preventing function is enabled.

Further, since the estimation map is updated so that the existence range of the load receiving member T is reduced when the track T2 of a part of the front end of the working device 13 in an operation of moving the bucket 13*bk* from the load input position by lowering the boom and turning the upper turning body 11*b* is closer to the load receiving member T than the track T1 of a part of the front end of the working device 13 in the lifting and turning operation, it is possible to further very accurately set the existence range of the load receiving member T by using the operation of moving the bucket 13*bk* from the load input position by lowering the boom and turning the upper turning body 11*b*. Accordingly, it is possible to further effectively prevent interference of the working device 13 with respect to the load receiving member T and to broaden an operable range of the working device 13 with respect to the load receiving member T without interference between the working device 13 and the load receiving member T and a control for the boom raising operation or the operation of turning the upper turning body 11*b* using the controller 37.

Then, it is possible to effectively input a load such as soil excavated by the bucket 13*bk* which is the working member to the load receiving member T without bringing the working device 13 into contact with the load receiving member T. Thus, it is possible to very appropriately use the bucket 13*bk* in the working machine 10 such as an excavator provided in the working device 13.

As a result, it is possible to easily and very safely perform a series of tasks including the excavating operation using the bucket 13*bk*, the lifting and turning operation, and the soil removing operation to reduce a risk of interference between the working device 13 and the load receiving member T and even to handle a change in excavation position of the bucket 13*bk*.

Furthermore, in the above-described embodiment, the controller 37 creates the estimation map which estimates the existence range of the load receiving member T based on the track T1 of a part of the front end of the working device 13 during at least one lifting and turning operation, but the invention is not limited to this configuration. For example, the boom raising operation and/or the operation of turning the upper turning body 11*b* can be controlled by directly comparing the track T1 of a part of the front end of the working device 13 during at least one lifting and turning operation with the current position of the front end of the working device 13.

Further, the working member is not limited to the bucket 13*bk*, and an arbitrary member capable of transporting a load and inputting the load into the load receiving member T can be used. For example, a grapple for grasping a load can be used.

INDUSTRIAL APPLICABILITY

The invention is suitable for an excavator-type working machine.

REFERENCE SIGNS LIST

T: load receiving member
10: working machine
11: machine body
11*a*: lower traveling body
11*b*: upper turning body
13: working device
13*bk*: bucket which is a working member
13*bm*: boom
37: controller

The invention claimed is:

1. A working machine comprising:

a machine body which includes a lower traveling body and an upper turning body provided to be turnable on the lower traveling body;

a working device which includes a boom axially connected to the upper turning body to be movable up and down and a working member provided to be operable at a front end of the working device to receive a load into the working member; and a controller which controls at least a turning movement of the upper turning body and an up and down movement of the boom in response to an operation of an operator, wherein the controller controls, at least any one of a boom raising operation and an upper turning body turning operation so that the working device does not contact a load receiving member in a subsequent lifting and turning operation of the operator based on a recorded track of a part of a front end of the working device during at least one lifting and turning operation of transporting the load received in the working member by raising the boom and turning the upper turning body so that the load is input into the load receiving member.

2. The working machine according to claim 1, wherein the controller creates an estimation map which estimates a load receiving member existence range based on the track of the part of the front end of the working device during at least one lifting and turning operation and controls at least any one of the boom raising operation and the upper turning body turning operation so that the working device does not move within the load receiving member existence range estimated in the estimation map by an operation of the operator in the subsequent lifting and turning operation.

3. The working machine according to claim 2, wherein the controller updates the estimation map so that the load receiving member existence range in the estimation map is reduced when the track of the part of the front end of the working device during an operation of moving the working member from a load input position by lowering the boom and turning the upper turning body is closer to the load receiving member than the track of the part of the front end of the working device during the lifting and turning operation.

4. The working machine according to claim 1, wherein the working member is an excavation bucket in which a load receiving position is an excavation position.

* * * * *